US007094182B1

(12) United States Patent
Holten

(10) Patent No.: US 7,094,182 B1
(45) Date of Patent: Aug. 22, 2006

(54) WRIST AND FOREARM EXERCISING APPARATUS

(76) Inventor: William S. Holten, 9 Willow Trail, Collinsville, IL (US) 62234

( * ) Notice: Subject to any disclaimer, the term of this patent is extended or adjusted under 35 U.S.C. 154(b) by 0 days.

(21) Appl. No.: 11/085,996

(22) Filed: Mar. 22, 2005

Related U.S. Application Data

(60) Provisional application No. 60/555,500, filed on Mar. 23, 2004.

(51) Int. Cl.
*A63B 23/14* (2006.01)

(52) U.S. Cl. ..... 482/46; 482/45; 482/115

(58) Field of Classification Search ..... 482/44–50, 482/114, 118, 115, 106–108
See application file for complete search history.

(56) References Cited

U.S. PATENT DOCUMENTS

| | | | | |
|---|---|---|---|---|
| 1,333,005 | A | | 3/1920 | Warner |
| 2,819,081 | A | | 1/1958 | Touraine |
| 2,973,962 | A | | 3/1961 | Griffin |
| 3,666,267 | A | | 5/1972 | McKinney |
| 3,746,336 | A | | 7/1973 | Tanimoto |
| 4,039,183 | A | | 8/1977 | Sakurada |
| 4,155,547 | A | | 5/1979 | Savio et al. |
| 4,239,208 | A | | 12/1980 | Walls |
| 4,258,913 | A | | 3/1981 | Brentham |
| 4,310,154 | A | | 1/1982 | Kauffman |
| 4,377,282 | A | | 3/1983 | Hayes |
| 4,461,473 | A | | 7/1984 | Cole |
| 4,589,655 | A | | 5/1986 | Ammon |
| 4,591,151 | A | | 5/1986 | Hensley |
| 4,618,143 | A | | 10/1986 | Twardosz |
| 4,623,141 | A | | 11/1986 | Salvino |
| 4,643,417 | A | | 2/1987 | Nieman |
| 4,690,400 | A | | 9/1987 | Metz |
| 4,770,409 | A | * | 9/1988 | Wallisch ..... 482/45 |
| 4,836,531 | A | | 6/1989 | Niks |
| 4,838,542 | A | * | 6/1989 | Wilkinson ..... 482/45 |
| 4,901,999 | A | | 2/1990 | Schott |
| 5,024,434 | A | * | 6/1991 | Smith ..... 482/107 |
| 5,046,727 | A | * | 9/1991 | Wilkinson et al. ..... 482/45 |
| 5,078,388 | A | | 1/1992 | Dempsey, Jr. |
| 5,281,192 | A | | 1/1994 | Nelson |
| 5,312,308 | A | | 5/1994 | Hamilton et al. |
| 5,372,557 | A | | 12/1994 | Ostigny |
| 5,380,261 | A | | 1/1995 | Mora |
| 5,425,690 | A | | 6/1995 | Chang |
| 5,454,769 | A | | 10/1995 | Chen |
| 5,569,136 | A | | 10/1996 | Holten |
| 5,620,398 | A | | 4/1997 | Moriarty |

(Continued)

*Primary Examiner*—Stephen R. Crow
*Assistant Examiner*—Allana Lewin
(74) *Attorney, Agent, or Firm*—Polster, Lieder, Woodruff & Lucchesi, L.C.

(57) ABSTRACT

Apparatus for exercising the forearm muscles responsible for movement of the hand at the wrist. The apparatus comprises two rigid rings adjoined by, and allowed to rotate about, the axis of a central, cylindrical variable resistance mechanism. The rigid rings each support a handgrip that is allowed to rotate about the inner circumference of each ring at variable resistance settings set with a peripheral resistance mechanism including an externally threaded terminal end of each handgrip, a knurled sleeve with internal threads at one end and external threads at the other. The knurled sleeve can be rotated about the axis of each handgrip, through internal threads of the inner ring, into the inner surface of the outer ring thereby creating a desired frictional resistance. The desired resistance can be preset and returned to through the incorporation of click-stops.

4 Claims, 6 Drawing Sheets

U.S. PATENT DOCUMENTS 5,634,871 A 6/1997 Froelich, Sr. et al.
5,676,622 A 10/1997 McFarlane
5,702,324 A 12/1997 Wendel et al.
5,718,654 A * 2/1998 Kennedy ..... 482/139
5,776,034 A 7/1998 Stamler
5,788,607 A 8/1998 Baker
5,833,580 A 11/1998 Chiu
5,873,805 A 2/1999 Ayres et al.
5,941,799 A 8/1999 Bergdorf
5,967,947 A 10/1999 Glover
5,976,059 A 11/1999 Brown
6,007,460 A 12/1999 Young
6,099,438 A 8/2000 Dawson
6,106,438 A 8/2000 Dean
6,117,093 A 9/2000 Carlson
6,152,858 A 11/2000 Kolb
6,228,001 B1 5/2001 Johnson et al.
6,234,934 B1 5/2001 Gorczyca
6,312,359 B1 11/2001 Brundle
6,406,406 B1 6/2002 Onorati
6,569,066 B1 5/2003 Patterson et al.
6,672,995 B1 1/2004 Baltodano

* cited by examiner

WRIST AND FOREARM EXERCISING APPARATUS

CROSS REFERENCE TO RELATED APPLICATIONS

This application claims the benefit of provisional patent application Ser. No. 60/555,500, filed Mar. 23, 2004, which is incorporated herein by reference.

BACKGROUND OF THE INVENTION

The present invention encompasses a portable exercise device designed to strengthen forearm muscles responsible for all ranges of hand movement at the wrist including flexion, extension, pronation, supination, ulnar and radial deviation. This device provides for a direct path of resistance to the physiological movements listed herein. In addition, this device provides a means to exercise both the left and right muscle groups simultaneously. Furthermore, this device provides methods for applying varying degrees of resistance to each side and each muscle group independently.

The exercises that can be performed with this device are right and left flexion of the hand at the wrist, right and left extension of the hand at the wrist, right and left pronation of the hand at the wrist, right and left supination of the hand at the wrist, right and left ulnar deviation of the hand at the wrist, and right and left radial deviation of the hand at the wrist. Typically flexion of one side would be countered by extension of the other side. In the same respect, ulnar deviation of one side would be countered by radial deviation of the other side. Pronation and supination, however, would typically be performed for each side at the same time, i.e., pronation of one side would be countered by pronation of the other side, and the same for supination. This device allows the user to exercise and strengthen all major forearm muscle groups responsible for movement of the hands at the wrist. Thereby, this device is designed to enhance athletic performance and aid in rehabilitation.

Devices designed to exercise forearm muscles responsible for movement of the hand at the wrist are known in prior art. There are literally hundreds of different products disclosed in patents or offered for sale designed to exercise forearm muscles. However, the demand for new and improved exercise devices is increasing. The exercise devices mentioned as known in the art do not meet the overall benefits of the present invention for a number of reasons: Many devices are limited to flexion or flexion and extension of the hand or the wrist only. None of these provide a means to perform pronation, supination, ulnar, or radial deviation. Others only allow for exercise of one side at a time. Many of the known devices also provide for pronation and supination only. These provide no means flexion, extension, ulnar or radial deviation. Others allow for ulnar and radial deviation only. These do not accommodate flexion, extension, ulnar or radial deviation. Also, certain known designs require weights for resistance which decreases the portability and requires loading and unloading to accommodate variable resistance.

Also known to the art are exercise apparatus that require elastic members for resistance which can lose elasticity with time and which vary greatly in resistance making preset resistance levels difficult to apply. Others require springs for resistance which are susceptible to the same disadvantages as the elastic resistance.

It would be desirable, therefore, to have a portable exercise device designed to strengthen forearm muscles responsible for all ranges of hand movement at the wrist including flexion, extension, pronation, supination, ulnar and radial deviation. This device provides for a direct path of resistance to the physiological movements listed herein. In addition, this device provides a means to exercise both the left and right muscle groups simultaneously. Furthermore, this device provides methods for applying varying degrees of resistance to each side and each muscle group independently. Also, it would be desirable to have such a device that does not employ springs or rubber bands or other biasing means that suffer from inherent shortcomings.

SUMMARY OF THE INVENTION

One aspect of the present invention provides for a portable exercise device designed to strengthen forearm muscles responsible for all ranges of hand movement at the wrist including flexion, extension, pronation, supination, ulnar and radial deviation.

Another aspect of the invention provides for a direct path of resistance to the physiological movements listed herein. In addition, another aspect of the invention provides a means to exercise both the left and right muscle groups simultaneously.

And yet another aspect of the invention provides methods for applying varying degrees of resistance to each side and each muscle group independently.

In accordance with the invention, briefly stated, a wrist and forearm exercising device is provided having two rigid rings which are adjoined by, and allowed to rotate about, the horizontal axis of a central, cylindrical resistance device. The resistance to rotation of the rings about the horizontal axis of the central device can be adjusted.

The rigid rings each support a handgrip that is allowed to rotate about the inner circumference of each ring. The device provides a tension mechanism to set variable resistance to rotation of the handgrip within each ring. The variable resistance to rotation of each handgrip about the inner circumference of each ring is accomplished by a peripheral resistance device comprised of the externally threaded terminal end of each handgrip and an internally threaded knurled sleeve. The knurled sleeve can be rotated about the terminal end of the handgrip thereby creating resistance via friction between the handgrip and the rigid outer ring.

More specifically a portable wrist and forearm exercise device is provided that includes two opposing, rigid ring assemblies connected by, and allowed to rotate about the axis of, a central resistance mechanism. The central resistance mechanism is comprised of externally threaded terminal ends for articulation with internally threaded floating bushings housed within stems positioned on the rigid outer rings, and a smooth central section for the user to grasp while rotating the knurled internally threaded sleeves about the externally threaded central sections for the purpose of increasing frictional resistance between the central resistance mechanism and the rigid ring assemblies. The central resistance mechanism includes a click-stop that can be preset for a desired resistance.

Each rigid ring assembly is comprised of an outer ring that supports, within its inner circumference, a rotatable rigid inner ring. A generally cylindrical, rigid handgrip bisects the inner ring. The handgrip, being attached to the rotatable inner ring, rotates within the outer ring around the inner circumference of the outer ring. Resistance to such rotation is provided by a peripheral resistance mechanism located at one terminal end of each of the handgrips.

Each peripheral resistance mechanism is comprised of one externally threaded terminal end of each handgrip and an internally threaded portion of a knurled sleeve. The knurled sleeve possesses an externally threaded portion that is threaded through the wall of the inner ring and urged against the outer ring for the purpose of creating frictional resistance on the inner surface of the outer ring. The peripheral mechanism possesses a click-stop that can be preset to a desired resistance setting.

In one aspect of the invention, the inner rings, via the handgrips, are rotated toward each other or into wrist pronation which is a palm downward orientation of the hand or away from each other into wrist supination which is a palm upward orientation of the hand.

In another aspect of the invention, the outer rings, via the handgrips, are twisted forward or into wrist flexion and reverse or wrist extension with respect to palm down orientation of the user.

In another aspect of the invention, the handgrips are tilted forward and reversed into wrist ulnar deviation or reversed into wrist radial deviation with respect to a palm inward orientation of the user. The handgrips would be vertical for a neutral position during this exercise.

DESCRIPTION OF THE PREFERRED EMBODIMENT

Figure 1:
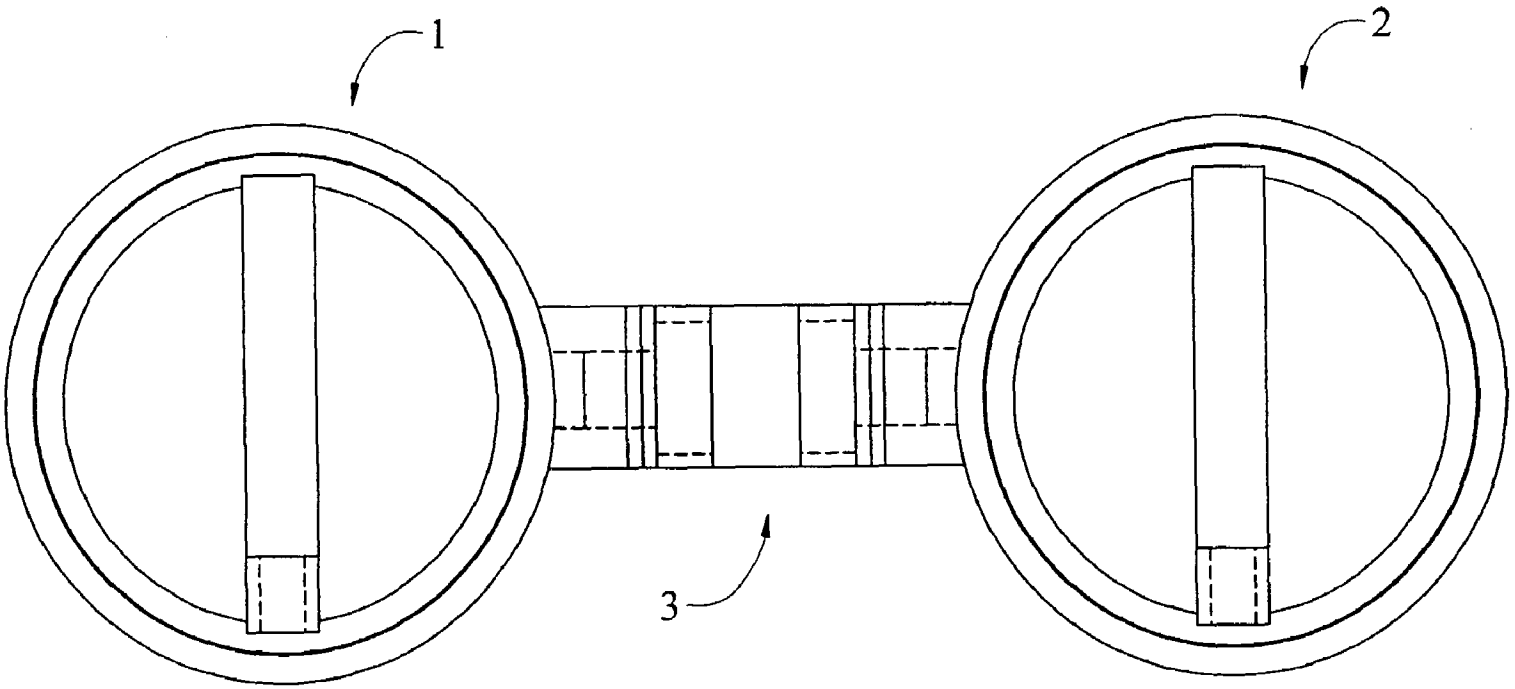
FIG. 1 is a front plan view of the wrist and arm exerciser of the present invention.
Figure 2:
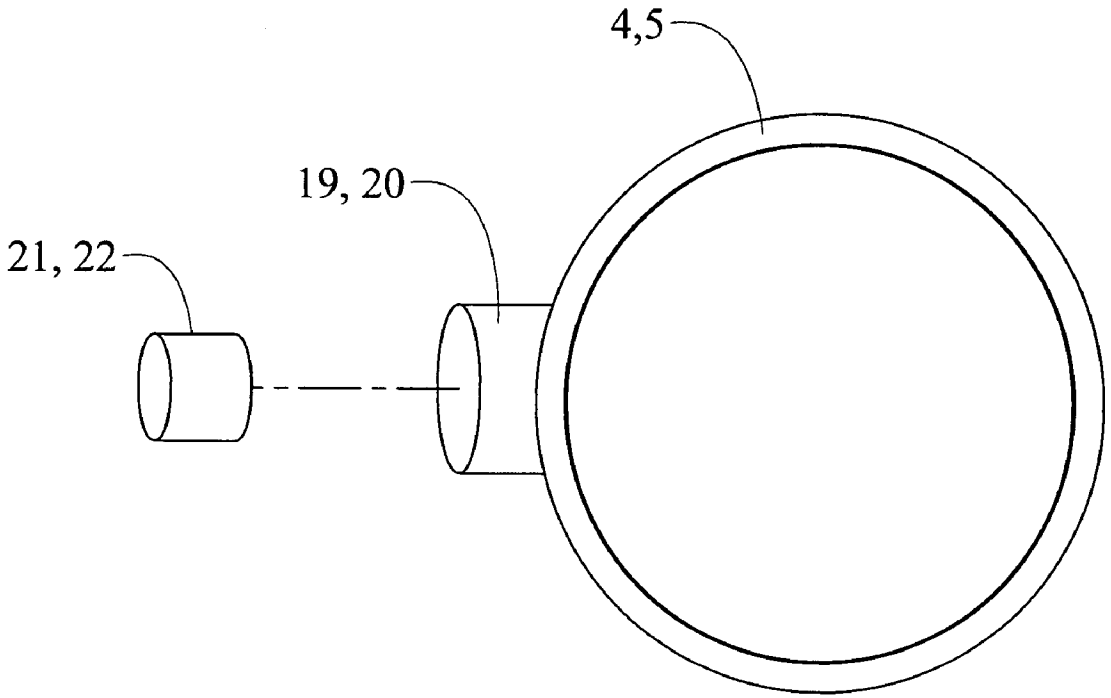
FIG. 2 is an exploded front plan of an outer ring.
Figure 4:
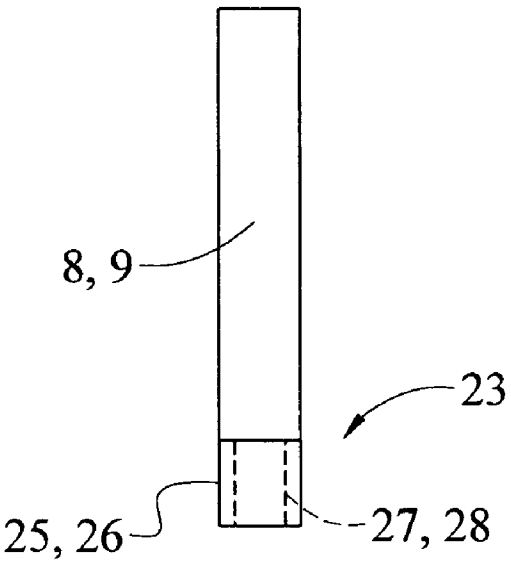
FIG. 4 is a front plan of a handgrip.
Figure 3:
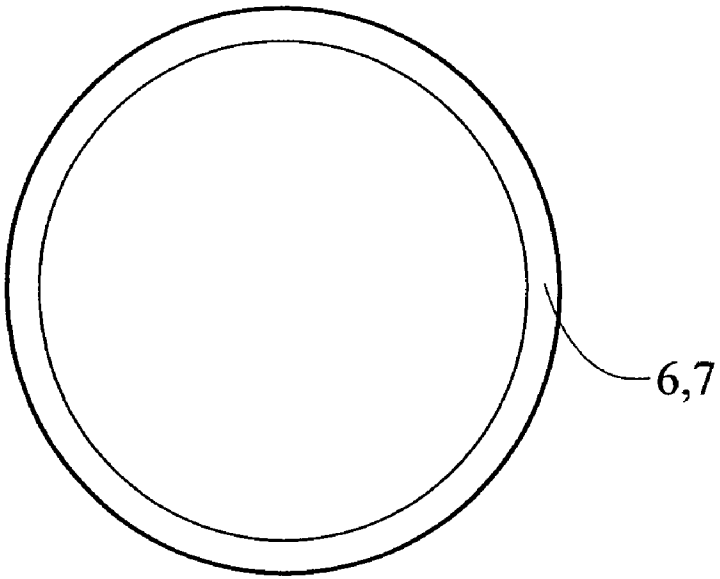
FIG. 3 is a front plan of an inner ring.
Figure 5:
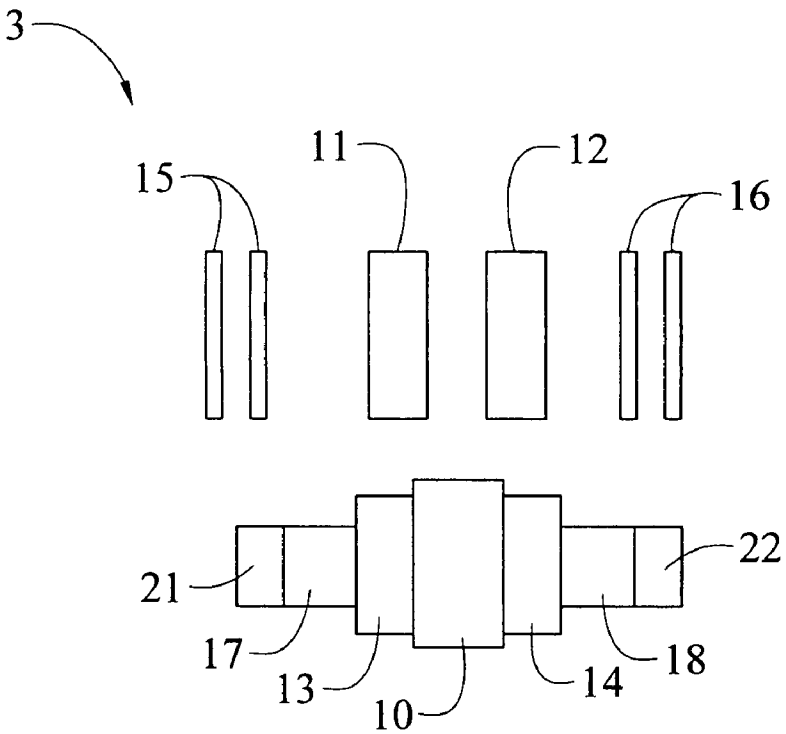
FIG. 5 is a front plan of the central resistance mechanism.
Figure 6:
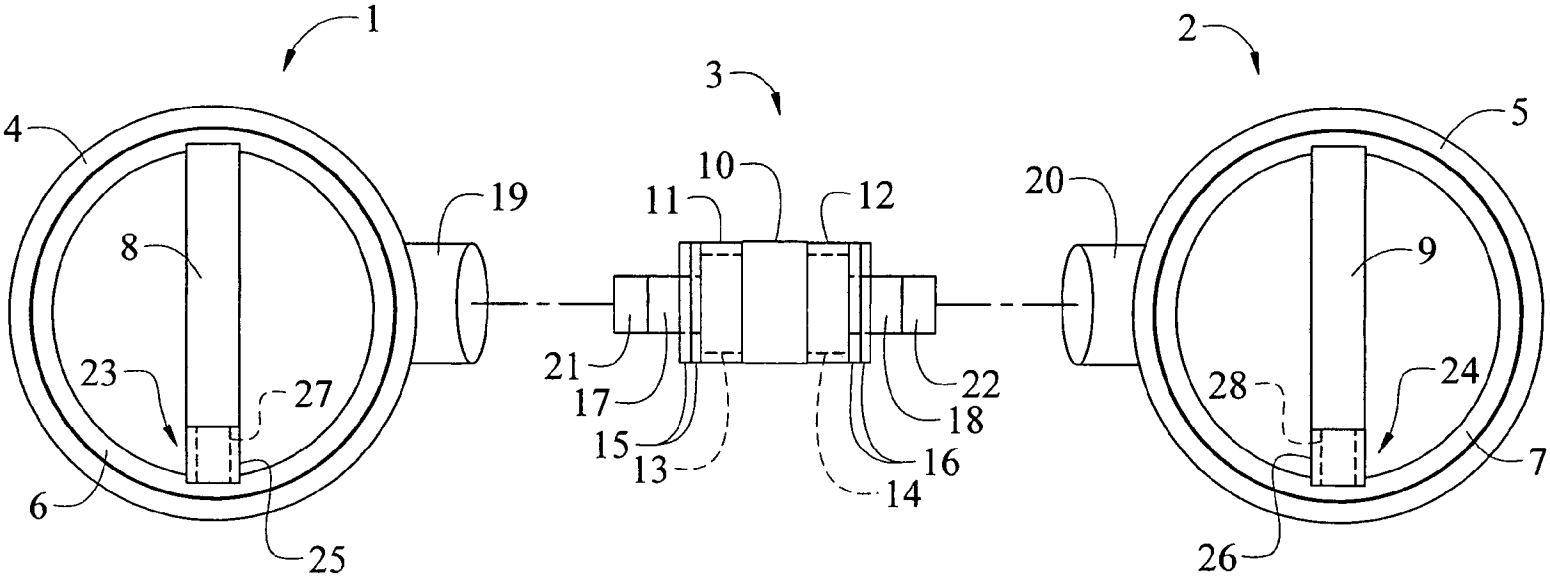
FIG. 6 is a front plan of the wrist and exerciser.
Figure 9:
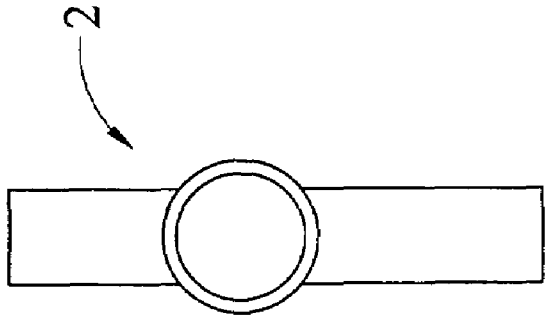
FIG. 9 is an end plan view of the right outer ring.
Figure 8:
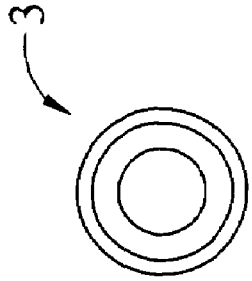
FIG. 8 is an end plan view of the central resistance mechanism.
Figure 7:
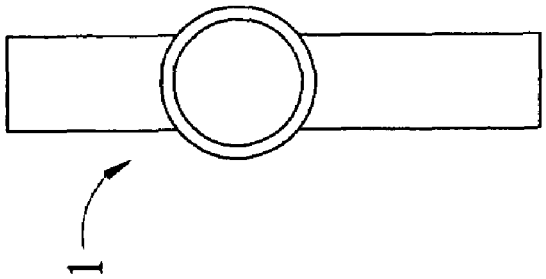
FIG. 7 is an end plan view of the left outer ring.

FIG. 1 shows the device in its assembled state. Opposed rigid, ring assemblies, 1 and 2, are connected to one another by a central resistance device 3. The ring assemblies 1 and 2 rotate about the axis of the central resistance mechanism 3 at preset variable degrees of resistance. The ring assemblies 1 and 2 consist of the following identifiable parts or sections respectively: outer rigid rings 4 and 5, stems 19 and 20 on the outer rings 4 and 5, the internally threaded, floating bushings within the stems 19 and 20 of the outer rings 4 and 5, rotatable inner rings 6 and 7 and grips 8 and 9. Handgrips 9 and 10 bisect the inner ring. Each ring assembly includes a peripheral resistance mechanism 23 and 24 composed of the threaded terminal ends 27 and 28 of the handgrips 8 and 9, and the internally threaded, knurled sleeves 25 and 26.

Outer rings 4 and 5 possess a surface configuration around their inner circumference that is concave or channel-shaped for the purpose of seating inner rings 6 and 7. Inner rings 6 and 7 possess a surface configuration about their outer circumference that is convex or the squared-off for the purpose of mating with the inner circumference of the rigid outer rings 4 and 5. Consequently, inner rings 6 and 7 can rotate within outer rings 4 and 5. Handgrips 8 and 9, therefore, move with the inner circumference of the rigid inner rings 6 and 7 when inner rings 6 and 7 rotate freely within the inner circumference of the rigid outer rings 4 and 5. Resistance to rotation of inner rings 6 and 7 within outer rings 4 and 5 is adjusted by the peripheral resistance mechanisms 23 and 24. Knurled sleeves 25 and 26 can be rotated about the axis of the handgrips 8 and 9, passing through an internally threaded section of the inner rings 6 and 7 and rotated into contact with the surface of the inner circumference of the outer rings 4 and 5 causing pre-selected variable degrees of resistance. The knurled sleeves of peripheral resistance mechanisms 23 and 24 contain internal threads that articulate with the external threads of the one terminal end of the handgrips, external threads that pass through internal threads located in the wall of the inner rings, and click stops which secure a preset degree of resistance and allow the user to return to that resistance setting.

Central resistance mechanism 3 consists of a smooth central section 10, the threaded central sections 13 and 14, smooth peripheral sections 17 and 18, threaded terminal sections 21 and 22, internally threaded knurled sleeves 11 and 12, and washers 15 and 16. Terminal portions 17 and 18 articulate with the smooth inner surface of the stems 19 and 20 of rigid outer rings 4 and 5. Threaded terminal portions 21 and 22 are threaded into threaded bushings housed in the stems 19 and 20 of the rigid outer rings 4 and 5. The stems 19 and 20 of the rigid outer rings 4 and 5 each possess a small internally threaded hole in one side that accommodates a set-screw. The set-screw is secured in a groove along the side of the floating internally threaded bushing during installation of the rigid ring assemblies 1 and 2 to the central resistance mechanism 3 and then removed for use.

Positioned adjacent to the central smooth portion 10 and encircling each central threaded portion 13 and 14 are knurled sleeves 11 and 12. Positioned peripheral to each central threaded portion 13 and 14 and encircling the terminal smooth portions 17 and 18, are a series of washers 15 and 16. Central smooth portion 10 is designed so that the user can grip it while turning each of the knurled sleeves 11 and 12, thereby moving the washers tighter against the stems 19 and 20 of the rigid outer rings 4 and 5, creating friction or drag as the rigid outer rings 4 and 5 are rotated about the axis of the central resistance mechanism 3.

A variety of materials may be incorporated into the construction of the rigid ring assemblies 1 and 2 and the central resistance mechanism 3 upon which they rotate. This invention envisions rigid plastics, rigid metals, or a combination thereof. A variety of configurations may be incorporated into the design of the rigid ring assemblies 1 and 2 and the central resistance mechanism 3 upon which they rotate with respect to size and shape to best accommodate function.

It can be appreciated that with the present invention, the forearm muscle groups that are responsible for flexion, extension, pronation, supination, ulnar deviation, and radial deviation of the hands at the wrists may be exercised simultaneously or exercised individually. The resistance mechanisms can be preset using the click-stops incorporated into the knurled sleeves to varying degrees of resistance that can be documented for progress and returned to at any time by the user.

Having described the presently preferred embodiment of the invention, it is to be understood that it may be otherwise embodied within the scope of the appended claims.

The invention claimed is:

1. An exercise device comprising:

a. a central substantially cylindrical resistance mechanism;

b. a ring assembly at each end of the central cylindrical resistance mechanism, each ring assembly comprising:

(i) a rigid, outer ring that articulates with the central resistance mechanism;

(ii) a rigid, rotatable, inner ring secured to an inner surface of the outer ring;

(iii) a handgrip mounted within the rotatable, inner ring; and (iv) a peripheral resistance mechanism to vary the resistance of rotation of the rotatable inner ring within the outer ring;

and wherein the central resistance mechanism provides frictional resistance to the ring assemblies.

2. The exercise device of claim 1 wherein variable resistance to rotation of the two rigid, stationary ring assemblies in opposite directions about the axis of the central substantially cylindrical resistance mechanism comprises means for creating varying degrees of friction between the rigid ring assemblies and the central cylindrical resistance mechanism.

3. The exercise device of claim 1 further comprising means for providing peripheral resistance mechanism whereby variable resistance can be placed upon the rotation of the inner ring within the circumference of the outer ring.

4. An exercise device comprising:

a. a central substantially elongated cylindrical resistance mechanism;

b. a first ring assembly at a first end of the central cylindrical resistance mechanism and a second ring assembly at a second end of the central cylindrical resistance mechanism, each ring assembly capable of rotation about the longitudinal axis of the central cylindrical resistance mechanism, each ring assembly comprising:

(i) a rigid, outer ring that articulates with the central resistance mechanism;

(ii) a rigid, rotatable, inner ring secured to an inner surface of the outer ring;

(iii) a handgrip mounted within the rotatable, inner ring; and (iv) a peripheral resistance mechanism to vary the resistance of rotation of the rotatable inner ring within the outer ring;

and wherein the central resistance mechanism provides frictional resistance to the ring assemblies when at least one of the ring assemblies is rotated about the longitudinal axis of the central resistance mechanism.

* * * * *